US010323531B2

(12) United States Patent
Bluck et al.

(10) Patent No.: US 10,323,531 B2
(45) Date of Patent: Jun. 18, 2019

(54) AIRFOIL DEVICE FOR A GAS TURBINE AND CORRESPONDING ARRANGEMENT

(71) Applicant: Siemens Aktiengesellschaft, Munich (DE)

(72) Inventors: Richard Bluck, Welton (GB); David Overton, Lincoln (GB)

(73) Assignee: Siemens Aktiengesellschaft, Munich (DE)

( * ) Notice: Subject to any disclaimer, the term of this patent is extended or adjusted under 35 U.S.C. 154(b) by 422 days.

(21) Appl. No.: 15/100,889

(22) PCT Filed: Nov. 11, 2014

(86) PCT No.: PCT/EP2014/074255
§ 371 (c)(1),
(2) Date: Jun. 1, 2016

(87) PCT Pub. No.: WO2015/086240
PCT Pub. Date: Jun. 18, 2015

(65) Prior Publication Data

US 2016/0298480 A1 Oct. 13, 2016

(30) Foreign Application Priority Data

Dec. 9, 2013 (EP) ..... 13196280

(51) Int. Cl.
*F01D 5/02* (2006.01)
*F01D 11/00* (2006.01)
(Continued)

(52) U.S. Cl.
CPC ..... *F01D 11/008* (2013.01); *F01D 5/02* (2013.01); *F01D 5/12* (2013.01); *F01D 5/3007* (2013.01);
(Continued)

(58) Field of Classification Search
None
See application file for complete search history.

(56) References Cited

U.S. PATENT DOCUMENTS 4,516,910 A 5/1985 Bouiller et al.
4,872,812 A 10/1989 Hendley et al.
(Continued)

FOREIGN PATENT DOCUMENTS

CH 698921 B1 12/2009
EP 2053285 A1 4/2009
(Continued)

OTHER PUBLICATIONS

CN Office Action dated Dec. 8, 2016, for CN patent application No. 201480067010.5.
(Continued)

*Primary Examiner* — Jason D Shanske
*Assistant Examiner* — Theodore C Ribadeneyra
(74) *Attorney, Agent, or Firm* — Beusse Wolter Sanks & Maire

(57) ABSTRACT

An airfoil device for a gas turbine has a root section mountable to an airfoil disc and an airfoil element. The root section has a platform at which the airfoil element is arranged. The root section has a cavity surrounded by an inner surface of the platform, a first and a second edge side of the root section. A seal strip is arranged at the inner surface, wherein the first edge side has a recess into which a first end section of the seal strip is arranged. The root section has a supporting lever extending from the second edge side into the cavity. The supporting lever is formed such that a further cavity is formed between the inner surface, the second edge side and the supporting lever, wherein the second end section of the seal strip is arranged inside the further cavity.

9 Claims, 4 Drawing Sheets

(51) Int. Cl.
*F01D 5/12* (2006.01)
*F01D 5/30* (2006.01)

(52) U.S. Cl.
CPC ..... *F01D 11/006* (2013.01); *F05D 2220/32* (2013.01); *F05D 2240/80* (2013.01)

(56) References Cited

U.S. PATENT DOCUMENTS

| | | | | |
|---|---|---|---|---|
| 4,936,749 | A | 6/1990 | Arrao et al. | |
| 5,284,421 | A | 2/1994 | Chlus et al. | |
| 5,478,207 | A * | 12/1995 | Stec | F01D 5/22 416/219 R |
| 5,573,375 | A * | 11/1996 | Barcza | F01D 5/22 416/190 |
| 5,924,699 | A * | 7/1999 | Airey | F01D 11/008 277/411 |
| 6,171,058 | B1 * | 1/2001 | Stec | F01D 5/22 416/193 A |
| 6,267,557 | B1 | 7/2001 | Chin | |
| 6,932,575 | B2 | 8/2005 | Surace et al. | |
| 7,467,924 | B2 * | 12/2008 | Charbonneau | F01D 5/22 416/193 A |
| 7,575,415 | B2 | 8/2009 | Drerup et al. | |
| 2002/0090296 | A1 | 7/2002 | Kuwabara et al. | |
| 2005/0175463 | A1 | 8/2005 | Giot et al. | |
| 2005/0220619 | A1 * | 10/2005 | Self | F01D 9/041 416/174 |
| 2006/0056974 | A1 * | 3/2006 | Beattie | F01D 5/10 416/193 A |
| 2010/0129226 | A1 | 5/2010 | Strohl et al. | |
| 2010/0158686 | A1 * | 6/2010 | Kim | F01D 5/22 416/1 |
| 2013/0136618 | A1 * | 5/2013 | Stapleton | F01D 5/143 416/235 |
| 2013/0195665 | A1 | 8/2013 | Snyder et al. | |

FOREIGN PATENT DOCUMENTS

| | | | |
|---|---|---|---|
| EP | 2054588 | A1 | 5/2009 |
| EP | 2201271 | A1 | 6/2010 |
| EP | 2201271 | B1 | 3/2012 |
| EP | 2054588 | B1 | 8/2012 |
| EP | 2551464 | A1 | 1/2013 |
| JP | H08504015 | A | 4/1996 |
| JP | 2002201913 | A | 7/2002 |
| JP | 2005528550 | A | 9/2005 |
| JP | 2006077759 | A | 3/2006 |
| RU | 2415272 | C2 | 3/2011 |
| WO | 2007063128 | A1 | 6/2007 |
| WO | 2008046684 | A1 | 4/2008 |
| WO | 2009053169 | A1 | 4/2009 |

OTHER PUBLICATIONS

JP Office Action dated May 15, 2017, for JP patent application No. 2016-538033.
RU Office Action dated Aug. 22, 2016, for RU patent application No. 2016122872.
JP Notice of Allowance dated Sep. 4, 2017, for JP patent application No. 2016-538033.

* cited by examiner

AIRFOIL DEVICE FOR A GAS TURBINE AND CORRESPONDING ARRANGEMENT

CROSS REFERENCE TO RELATED APPLICATIONS

This application is the U.S. National Stage of International Application No. PCT/EP2014/074255 filed Nov. 11, 2014, and claims the benefit thereof. The International Application claims the benefit of European Application No. EP13196280 filed Dec. 9, 2013. All of the applications are incorporated by reference herein in their entirety.

FIELD OF INVENTION

The present invention relates to an airfoil device for a gas turbine and an airfoil arrangement for a gas turbine.

ART BACKGROUND

In gas turbines, airfoil devices are arranged in order to guide a working fluid through a gas turbine. The airfoil devices may comprise blades which are mounted to a rotating turbine shaft or vanes which are mounted for example to a housing of the gas turbine. The airfoil devices are mounted in a circumferential direction around the turbine shaft one after another. A gap may exist between adjoining airfoil devices such that leakage occurs. For this reason, a sealing arrangement is required between adjacent airfoil devices. By attaching a sealing arrangement between adjacent airfoil devices, an injection of hot working gas into inner cavities of the airfoil devices is prevented. Moreover, cooling air which flows through cavities inside the airfoil devices is prevented from disappearing out into the mainstream flow of the hot working gas before being put to use. Moreover, a sealing arrangement is beneficial because the working fluid is guided through the airfoil passage without losing energy through the gaps between adjacent sealing devices.

FIG. 5 illustrates a conventional airfoil device 400. A conventional airfoil 401 is arranged onto a conventional platform 402. The conventional platform 402 comprises a conventional root section 404. Within the conventional route section, a groove for arranging a conventional seal strip 405 is formed. Below the platform 402, a conventional cavity 403 is formed. The conventional seal strip 405 is decoupled from the conventional cavity 403.

EP 2 054 588 B1 discloses an airfoil device, wherein a platform of the airfoil device comprises a slot into which is seal strip is arranged.

EP 2 201 271 B1 discloses an airfoil device, wherein a sealstrip is arranged with a first end section inside a first groove of a root section of the airfoil device and a second end section is arranged inside the second groove of the root section of the airfoil device.

EP 2 551 464 A1 discloses an airfoil device which comprises a platform, wherein under the platform a cavity is form. A seal strip is arranged inside the cavity without an underside support.

SUMMARY OF THE INVENTION

It may be an object of the present invention to provide an airfoil device comprising a seal strip which has a reduced weight and proper sealing properties.

This object is solved by an airfoil device for a gas turbine and a turbine arrangement for a gas turbine according to the independent claims.

According to a first aspect of the present invention, an airfoil device for a gas turbine is presented. The airfoil device comprises a root section which is mountable to an airfoil disc of the gas turbine and an airfoil element.

The root section comprises a platform at which the airfoil element is arranged. The root section comprises a cavity which is surrounded by an inner surface of the platform, a first edge side (e.g. a downstream edge side) of the root section and a second edge side (e.g. an upstream edge side) of the root section. The first edge side and the second edge side are spaced apart from each other along an axial direction of the gas turbine.

A seal strip is arranged at the inner surface. The seal strip has a first end section, a middle section and a second end section, wherein the first end section is spaced apart from the second end section along the axial direction and the middle section is arranged between the first end section and the second end section.

The first edge side comprises a recess (groove, slit) into which the first end section of the seal strip is inserted such that the recess (partially) surrounds the first end section and thereby fixes the first end section to the inner surface.

The root section comprises a supporting lever extending from the second edge side into the cavity such that a free end of the supporting lever forms a contact region with the middle section of the seal strip for fixing the middle section of the seal strip to the inner surface. The supporting lever is further formed such that a further cavity is formed between the inner surface, the second edge side and the supporting lever, wherein the second end section of the seal strip is arranged inside the further cavity.

The root section comprises the platform, the first (trailing) edge side and the second (leading) edge side. The platform has a first (outer) surface which faces to a mainstream flow channel of the gas turbine and a second (inner) surface which faces to an opposite region of the platform in comparison to the first surface. The airfoil element, such as a blade, is attachable to the first surface.

The platform extends generally along a circumferential direction and an axial direction of the gas turbine. The thickness of the platform i.e. its extension along the normal of the inner surface, e.g. along the radial direction, is generally smaller in comparison to the other extensions, e.g. to the extensions along the axial and circumferential direction.

The terms axial direction, circumferential direction and radial direction refer to directions with respect to a turbine shaft of the gas turbine. The circumferential direction describes a run around the gas turbine shaft, the radial direction describes a run through a point of the rotating axis of the turbine shaft and the axial direction describes a run parallel to the rotating axis of the turbine shaft. The axial direction and the radial direction are orientated in particular perpendicular with respect to each other.

The (second) leading edge side and the (first) trailing edge side are attached to the platform. The second edge side and the first edge side run from the inner surface of the platform along a substantially radial direction. The second edge side is located more upstream with respect to the first edge side or vice versa, wherein "upstream" and "downstream" describe a location of a part along a flow direction of the main stream of the working fluid of the gas turbine. Hence, the platform, the first edge side and the second edge side may form a U-shape inner cross-section inside the cavity and the further cavity is formed. The above-described structure of the airfoil device is valid for the described airfoil device and e.g. also for the further airfoil device described below.

The recess (slit or groove) of the first edge side may have an U-shaped cross section, wherein the first end section of the seal strip may be inserted and slipped into the recess through its open side.

The cavity and the further cavity may be flushed with cooling air, wherein the cooling air may be fed from or to a hollow airfoil or the blade root for cooling purposes. The cavity may also be surrounded additionally by a bottom side which is connected to the trailing edge side and the leading edge side and which bottom side is located on the opposite side of the cavity in comparison to the inner surface of the platform.

A plurality of airfoil devices are mounted adjacent to each other to an airfoil disc along the circumferential direction. In particular, the first platform and a further platform of an adjacent further airfoil device abut against each other, wherein, for example due to assembly tolerances and growth allowance (centrifugal and thermal) during operation, small gaps exist between both platforms.

The supporting lever extends from the second edge side into the cavity and hence protrudes into the cavity. The supporting lever is formed in such a way that a gap between a free end of the supporting lever and the inner surface is formed. The seal strip arranged onto the inner surface protrudes through the gap. In other words, the supporting lever forms with its free end contact region with the middle section of the seal strip and thereby presses and may fix or force the middle section of the seal strip to the inner surface. The seal strip is retained or secured in the cavity by the supporting lever preventing the second end section moving radially inwardly of the stopper section. Thus in normal operation the seal strip is held within the cavity.

Furthermore, the supporting lever divides the cavity such that the further cavity is formed between the inner surface, the second edge side and the supporting lever, wherein the second end section of the seal strip is arranged inside the further cavity.

The seal strip may be formed of a metal strip or a metal plate, accordingly. The seal strip is in contact with the inner surface of the airfoil device and a further inner surface of an adjacent further airfoil device and thus seals a gap between two adjacent platforms.

By the present invention, the support lever extends only part-way along the axial direction into the cavity and along the inner surface. In contrast to conventional approaches, where the complete underside of the seal trip is supported by a support surface, by the present invention the overall weight of the airfoil device is reduced and hence also stress at the airfoil device and turbine disc is reduced.

Furthermore, by the present invention only the first end section of the seal strip is inserted into the recess, wherein the opposed second end section of the seal strip is not surrounded by a recess or groove for support purposes. The seal strip is held against the inner surface by the free end of the support lever. Hence, an easy installation of the seal strip is provided. The seal strip is elastically deformable into a spring loaded condition during installation. In the spring loaded status, the seal strip is slid along the circumferential direction with its middle portion inside the gap between the free end of the supporting lever and the inner surface. The first end section and the second end section are movable within the cavity and the further cavity. During installation the first end section is inserted slideably into the recess at the first edge side of the root section. The spring loaded status of the seal strip is then released so that the second end section unfolds and contacts in a final position the inner surface and e.g. the below described stopper section.

According to a further exemplary embodiment of the present invention, a first part of the middle section of the seal strip between the contact region and the first end section is arranged inside the cavity. The second end section and a second part of the middle section of the seal strip between the contact region and the second end section is arranged inside the further cavity. Hence, the second end section is not supported in radial direction.

In a further exemplary embodiment, the supporting lever is formed such that a first axial length of the seal strip between the contact region and the first end section is larger than a second axial length of the seal strip between the contact region and the second end section. Hence, because of the shorter second axial length between the contact region and the second end section, the seal strip may be formed stiffener such that the shorter second axial length part of the seal strip does not deform due to the own weight of the shorter second axial length part.

According to a further exemplary embodiment, the second edge side comprises a seal strip inlet for inserting the seal strip into the further cavity.

The seal strip inlet is formed such that a fitment of the seal strip with blades already in-situ is enabled. In particular, the seal strip inlet may be formed at the upstream (second) edge side and connects an upstream environment of the airfoil device with the further cavity.

Hence, the seal strip may be inserted through the seal strip inlet along approximately the axial direction into the further cavity. Furthermore, the seal strip may be further moved along approximately the axial direction until the first end section 109 of the seal strip is arranged within the recess in the downstream (first) edge side.

According to a further exemplary embodiment, the seal strip inlet is formed such that air is streamable out of the further cavity. Hence, air may stream from the cavity via the contact region (i.e. the gap between the free end of the supporting lever and the inner surface of the platform) through further cavity and exits the seal strip inlet. This air flow is intentionally reduced by minimizing the gap between the free end of the supporting lever and the inner surface of the platform.

According to a further exemplary embodiment, the second edge side comprises a stopper section (step or protrusion) which is formed such that the second end section of the seal strip abuts against the stopper section. In particular, the stopper section comprises a surface which has a normal that is (at least with a component) parallel to the axial direction. The seal strip abuts against the stopper section, if the seal strip is moved out of the recess along the axial direction. Hence, the stopper section limits a movement of the seal strip along the axial direction, such that a slipping out of the recess is prevented.

According to a further exemplary embodiment, the first edge side is a trailing edge side of the root section, wherein the second edge side is a leading edge side of the root section.

According to a further exemplary embodiment, an airfoil arrangement is described, wherein the airfoil arrangement comprises an above described airfoil device and a further airfoil device. The airfoil device and the further airfoil device are arranged one after another along a circumferential direction of the gas turbine, wherein the seal strip is formed such that the seal strip extends between the airfoil device and the further airfoil device for sealing a gap between the airfoil device and the further airfoil device.

It has to be noted that embodiments of the invention have been described with reference to different subject matters. In particular, some embodiments have been described with reference to apparatus type claims whereas other embodiments have been described with reference to method type claims. However, a person skilled in the art will gather from the above and the following description that, unless other notified, in addition to any combination of features belonging to one type of subject matter also any combination between features relating to different subject matters, in particular between features of the apparatus type claims and features of the method type claims is considered as to be disclosed with this application.

BRIEF DESCRIPTION OF THE DRAWINGS

The aspects defined above and further aspects of the present invention are apparent from the examples of embodiment to be described hereinafter and are explained with reference to the examples of embodiment. The invention will be described in more detail hereinafter with reference to examples of embodiment but to which the invention is not limited.

DETAILED DESCRIPTION

Figure 1:
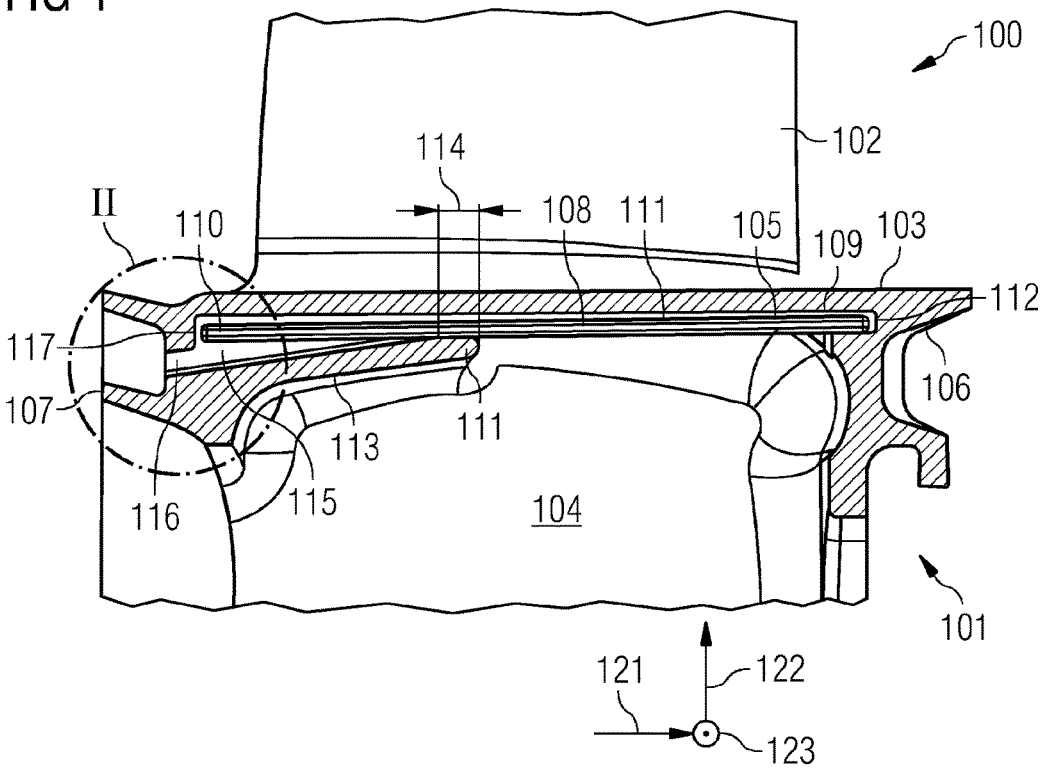
FIG. 1 shows a schematic view of an airfoil device according to an exemplary embodiment of the present invention.

The illustrations in the drawings are schematic. It is noted that in different figures similar or identical elements are provided with the same reference signs.

FIG. 1 shows an airfoil device 100 for a gas turbine according to an exemplary embodiment of the present invention. The airfoil device 100 comprises a root section 101 which is mountable to an airfoil disc of the gas turbine. The root section 101 may therefore comprise a mounting bottom section which comprises e.g. a mounting plug which may be formed in a fir tree shape (see FIG. 3).

The airfoil device 100 further comprises an airfoil element 102, wherein the root section 101 comprises a platform 103 at which the airfoil element 102 is arranged. The root section 101 comprises a cavity 104 which is surrounded by an inner surface 105 of the platform 103, a first edge side 106 of the root section 101 and a second edge side 107 of the root section 101. The first edge side 106 and the second edge side 107 are spaced apart from each other along an axial direction 121 of the gas turbine.

A seal strip 108 is arranged at the inner surface 105. The seal strip 108 has a first end section 109, a middle section 111 and a second end section 110, wherein the first end section 109 is spaced apart from the second end section 110 along the axial direction 121 and the middle section 111 is arranged between the first end section 109 and the second end section 110. The first edge side 106 comprises a recess 112 into which the first end section 109 of the seal strip 108 is arranged such that the recess 112 surrounds the first end section 109 and fixes the first end section 109 to the inner surface 105.

The root section 101 comprises a supporting lever 113 extending from the second edge side 107 into the cavity 104 such that a free end of the supporting lever 113 forms a contact region 114 with the middle section 111 of the seal strip 108 for fixing the middle section 111 of the seal strip 108 to the inner surface 105. The supporting lever 113 is further formed such that a further cavity 115 is formed between the inner surface 105, the second edge side 107 and the supporting lever 113. The second end section 110 of the seal strip 108 is arranged inside the further cavity 115.

The root section 101 comprises the platform 103, the first (trailing) edge side 106 and the second (leading) edge side 107. The platform 103 has a first (outer) surface which faces to a mainstream flow channel of the gas turbine and a second (inner) surface 105 which faces to an opposite region of the platform 103 in comparison to the first surface. The airfoil element 102, such as a blade, is attachable to the first surface.

The platform 103 extends generally along a circumferential direction 123 and an axial direction 121 of the gas turbine. The thickness of the platform 103 i.e. its extension along the normal of the inner surface 105, e.g. along the radial direction 122, is generally smaller in comparison to the other extensions, e.g. to the extensions along the axial direction 121 and circumferential direction 123.

The terms axial direction 121, circumferential direction 123 and radial direction 122 refer to directions with respect to a turbine shaft 20 (see FIG. 4) of the gas turbine. The circumferential direction 123 describes a run around the gas turbine shaft 20 the radial direction 122 describes a run through a point of the rotating axis of the turbine shaft 20 and the axial direction 121 describes a run parallel to the rotating axis of the turbine shaft 20. The axial direction 121 and the radial direction 122 are orientated in particular perpendicular with respect to each other.

The (second) leading edge side 107 and the (first) trailing edge side 106 are attached to the platform 103. The second edge side 107 and the first edge side 106 run from the inner surface 105 of the platform 103 along a substantially radial direction 122. The second leading edge side 107 is located more upstream with respect to the first edge side 106. Hence, the platform 103, the first edge side 106 and the second edge side 107 form a kind of a U-shape inner cross-section inside the cavity 104 and the further cavity 115 is formed.

The recess (slit or groove) 112 of the first edge side 106 has an U-shaped cross section, wherein the first end section 109 of the seal strip 108 is inserted and slipped into the recess 112 through its open side.

The cavity 104 and the further cavity 115 may be flushed with cooling air, wherein the cooling air may be fed from a hollow airfoil 102 or the root section 101 for cooling purposes.

The supporting lever 113 extends from the second edge side 107 into the cavity 104 and hence protrudes into the cavity 104. The supporting lever 113 is formed in such a way that a gap between a free end of the supporting lever 113 and the inner surface 105 is formed. The seal strip 108 arranged onto the inner surface 105 protrudes through the gap. In other words, the supporting lever 113 forms with its free end contact region 114 with the middle section 111 of the seal strip 108 and thereby presses and fixes the middle section 111 of the seal strip 108 to the inner surface 105.

Furthermore, the supporting lever 113 divides the cavity 104 such that a further cavity 115 is formed between the inner surface 105, the second edge side 107 and the supporting lever 113, wherein the second end section 110 of the seal strip 108 is arranged inside the further cavity 115.

The seal strip 108 is in contact with the inner surface 105 of the airfoil device 100 and a further inner surface of an adjacent further airfoil device and thus seals a gap between two adjacent platforms 103.

As can be taken from FIG. 1, the support lever 113 extends only part-way along the axial direction 121 into the cavity 104 and along the inner surface 105. Only a first end section 109 of the seal strip 108 is inserted into the recess 112, wherein the opposed second end section 110 of the seal strip 108 is not surrounded by a further recess or groove for support purposes. The seal strip 108 is held against the inner surface 105 by the free end of the support lever 113. Hence, an easy installation of the seal strip 108 inside the inner cavity 104 is provided.

As shown in FIG. 1, a part of the middle section 111 of the seal strip 108 between the contact region 114 and the first end section 109 is arranged inside the cavity 104. The second end section 110 and a second part of the middle section 111 of the seal strip 108 between the contact region 114 and the second end section 110 is arranged inside the further cavity 115.

In particular, as can be taken from FIG. 1, the supporting lever 113 is formed such that a first axial length of the seal strip 108 between the contact region 114 and the first end section 109 is larger than a second axial length of the seal strip 108 between the contact region 114 and the second end section 110. Hence, because of the shorter second axial length between the contact region 114 and the second end section 110, the seal strip 108 may be formed stiffener such that the shorter second axial length part of the seal strip 108 does not deform due to the own weight of the shorter second axial length part.

The location of the contact region 114 and the length of the support lever 113 will depend on the length of the middle section 111 and the angle by which the support lever 113 is approaching the inner surface 105. Or put differently, how much elastic deflection can be accomplished by the seal strip during installation with a controllable force.

The second edge side 107 comprises a seal strip inlet 116 for inserting the seal strip 108 into the further cavity 115.

The seal strip inlet 116 is formed such that a fitment of the seal strip 108 with blades already in-situ is enabled. In particular, the seal strip inlet 116 may be formed at the upstream (second) edge side 107 and connects an upstream environment of the airfoil device 100 with the further cavity 115. Hence, the seal strip 108 may be inserted through the seal strip inlet 116 along approximately the axial direction 121 into the further cavity 115. Furthermore, the seal strip 108 may be further moved along approximately the axial direction 121 until the first end section 109 of the seal strip 108 is arranged within the recess 112 in the downstream (first) edge side 106.

A further benefit of having the seal strip inlet 116 at the upstream side is that the pressure differences acting on and across the seal strip would push the seal strip further in and up in the groove rather than away and out.

The second edge side 107 comprises a stopper section 117 which is formed such that the second end section 110 of the seal strip 108 abuts against the stopper section 117.

Figure 2:
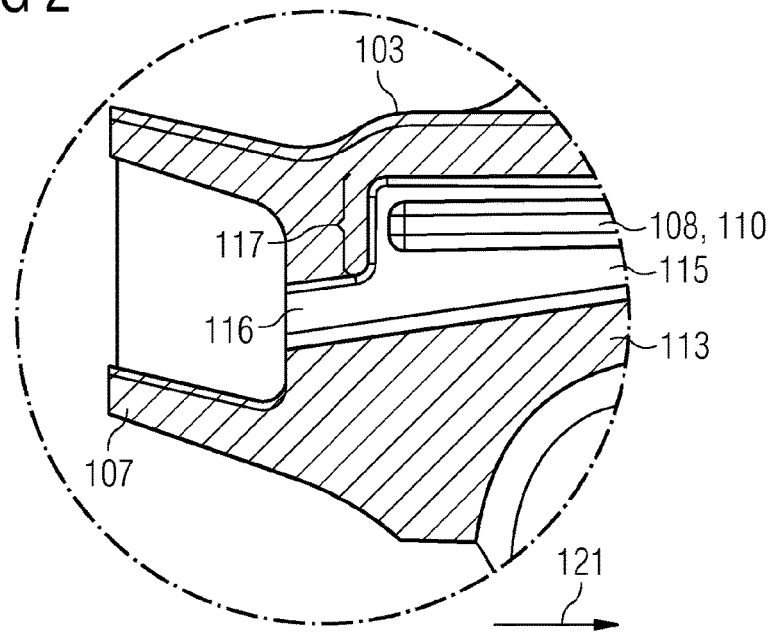
FIG. 2 shows an enlarged view of a stopper section of the airfoil device as shown in FIG. 1.

FIG. 2 shows an enlarged view of a stopper section 117 of the airfoil device 100 as shown in FIG. 1. The stopper section 117 comprises a step or protrusion which protrudes from second edge side 107 or the inner surface 105 into the further cavity 115. The stopper section 117 has a surface which has a normal that is (at least with a component) parallel to the axial direction 121. The seal strip 108 abuts against the stopper section 117, if the seal strip 108 is moved out of the recess 112 upstream and along the axial direction 121. Hence, the stopper section 117 limits a movement of the seal strip 108 along the axial direction 121, such that a slipping out of the recess 112 is prevented.

Figure 3:
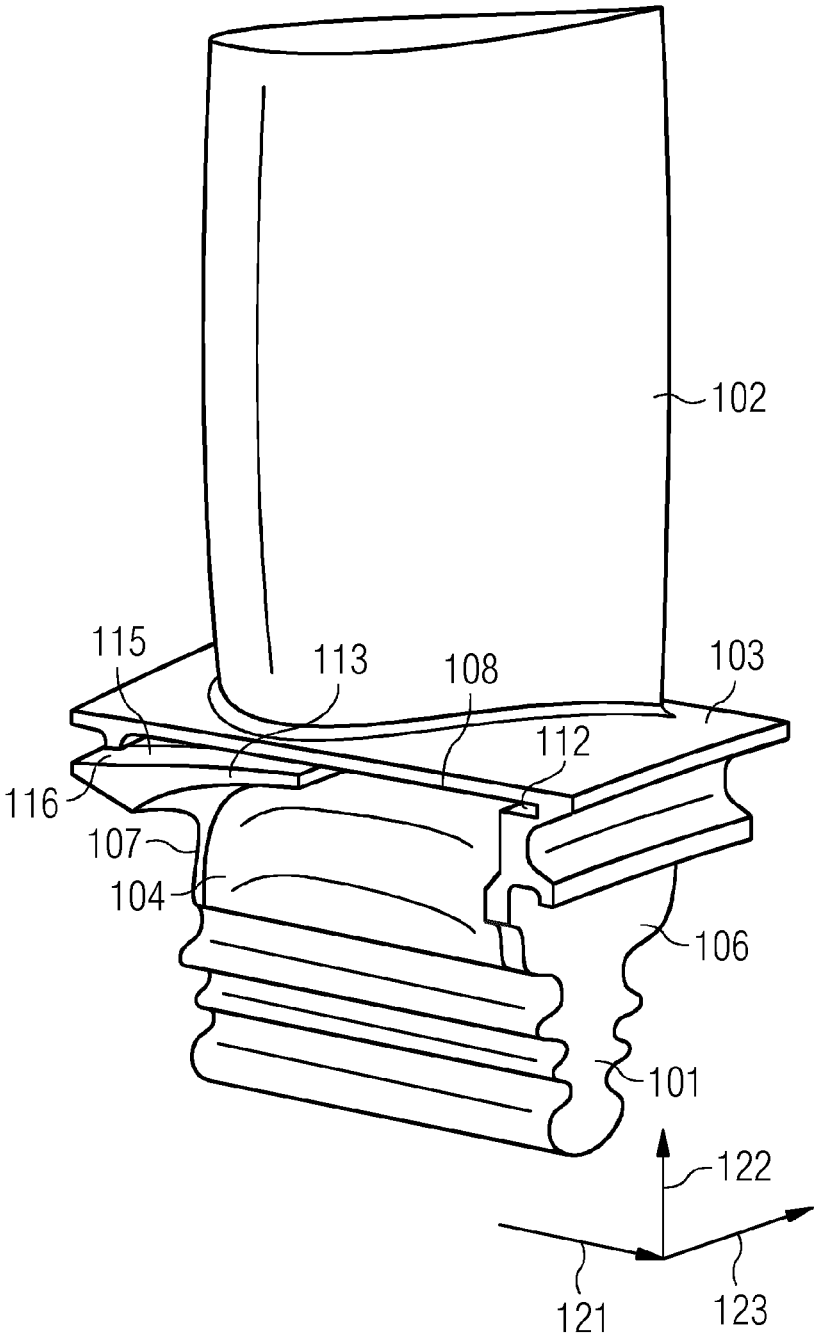
FIG. 3 shows a perspective view of the airfoil device as shown in FIG. 1.

FIG. 3 shows a perspective view of the airfoil device 100 as shown in FIG. 1.

When the seal strip 108 is assembled to the airfoil device 100 and/or between two circumferentially adjacent airfoil devices 100, the seal the middle section 111 of the seal strip 108 is inserted via the seal strip inlet 116 and will contact both the inner surface 105 and supporting lever 113. Continued insertion causes the supporting lever 113 to exert a force on the seal strip 108 which in turn forces against the inner surface 105. The seal strip 108 elastically deforms and/or the supporting lever 113 elastically deforms to accommodate and permit continued insertion of the seal strip 108. Once the first end section 109 is at least partly in the recess 112 and the second end 110 clears (i.e. is axially rearward) the stopper section 117, the seal strip 108 springs into the position shown in FIG. 1. Although the seal strip 108 is shown as a straight member the seal strip 108 can be arcuate in the axial and/or circumferential direction to aid fitting and securing into its cavity 104. To remove or disassemble the seal strip 108 from the cavity 104, the second end section 110 is forced radially inwardly such that the seal strip 108 and/or the supporting lever 113 flexes or elastically deforms so that the second end section 110 is radially inwardly of the stopper section 117. The seal strip 108 can then be moved axially forwardly and removed from the cavity 104.

The seal strip 108, as shown in FIG. 1, is retained or secured in the cavity by virtue of the supporting lever 113 preventing the second end section 110 moving radially inwardly of the stopper section 117. It should be appreciated that during engine operation the seal strip 11 will be forced radially outwardly against the inner surface 105 by centrifugal effects. When the engine is not in operation, the seal strip 108 may rest against the supporting lever 113 and the recess 112 and not in contact with the inner surface 105. Furthermore, the circumferential edges or parts of the circumferential edges of the strip seal 108 may be in contact with the inner surface 105.

When the seal strip 108 is assembled to the airfoil device 100 and/or between two circumferentially adjacent airfoil devices 100 it seals the generally axial gap between each platform along their axial extents to prevent ingress of hot gases to the cavity 104. It should be appreciated that circumferentially adjacent airfoil devices 100 each comprise a cavity 104 and one or both may have a supporting lever 113.

Figure 4:
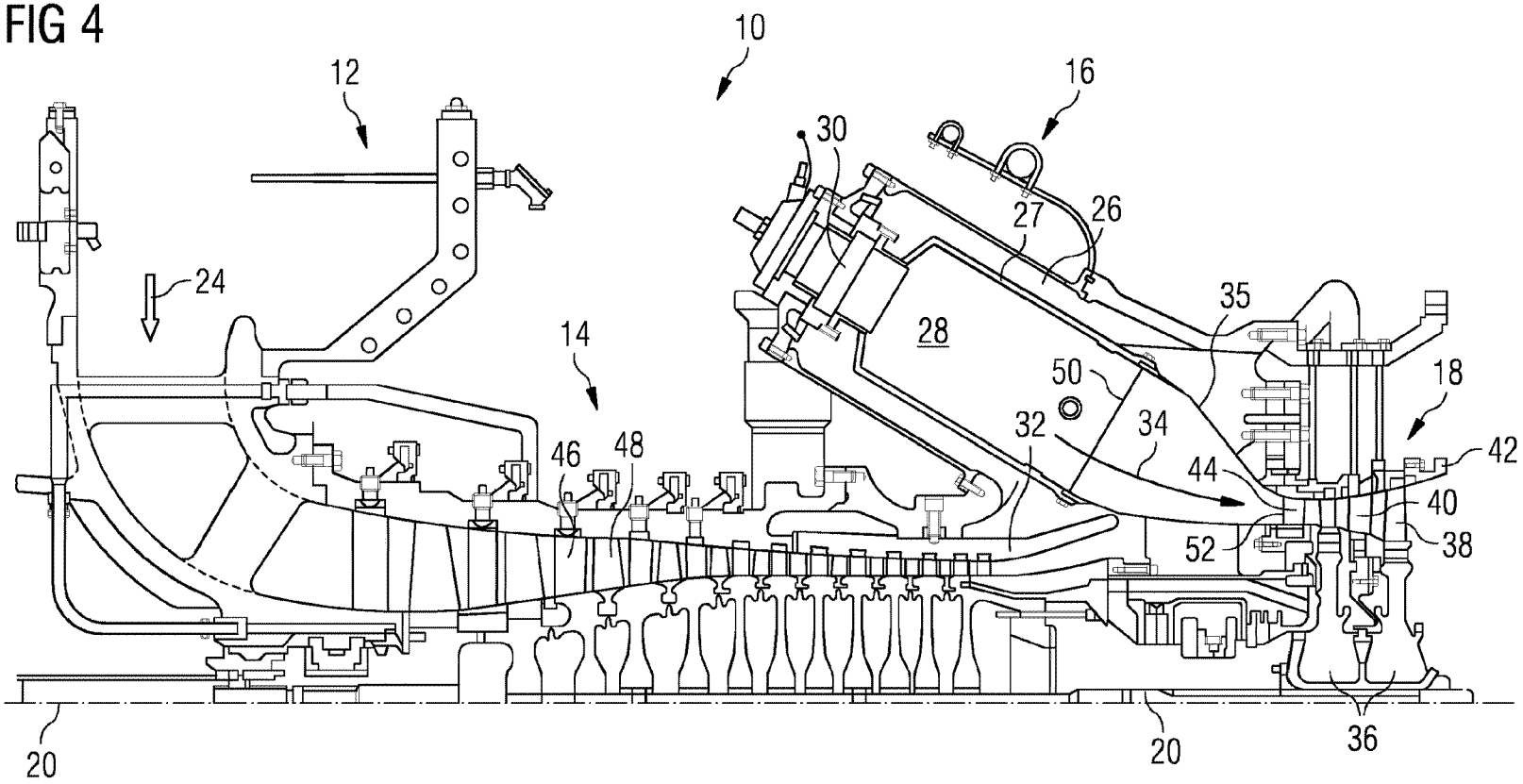
FIG. 4 shows a gas turbine engine according to an exemplary embodiment of the present invention.
Figure 5:
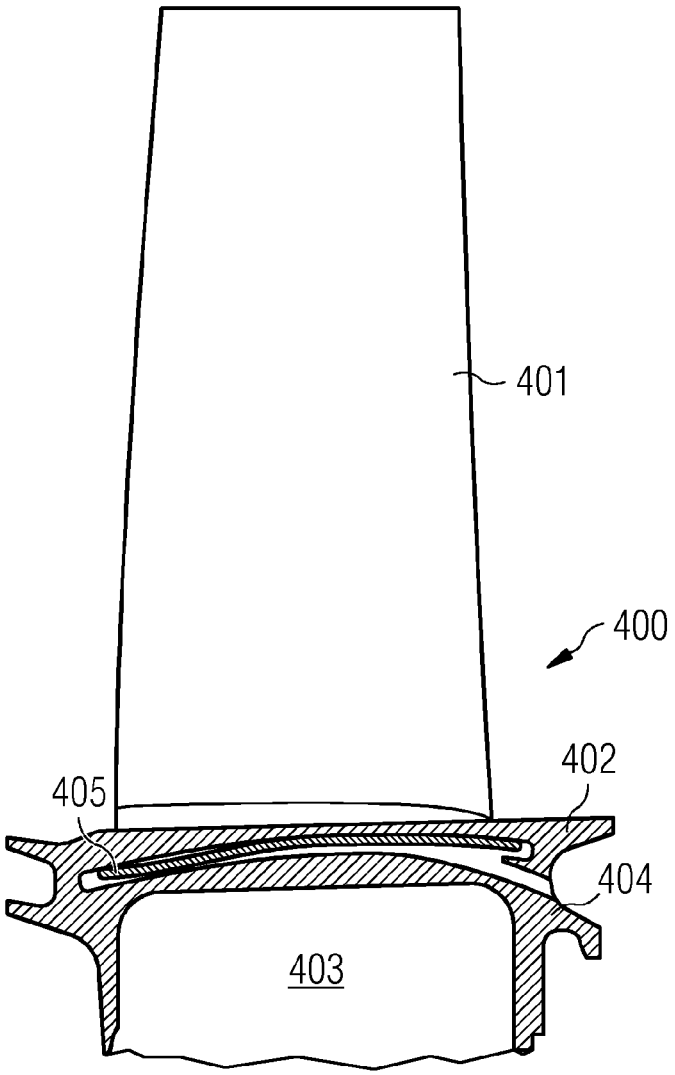
FIG 5 PRIOR ART
FIG. 5 shows a conventional airfoil device.

FIG. 4 shows an example of a gas turbine engine 10 in a sectional view. The gas turbine engine 10 comprises, in flow series, an inlet 12, a compressor section 14, a combustor section 16 and a turbine section 18 which are generally arranged in flow series and generally in the direction of a longitudinal or rotational axis. The gas turbine engine 10 further comprises a shaft 20 which is rotatable about the rotational axis and which extends longitudinally through the gas turbine engine 10. The shaft 20 drivingly connects the turbine section 18 to the compressor section 14.

The terms upstream and downstream refer to the flow direction of the airflow and/or working gas flow through the engine unless otherwise stated. The terms forward and rearward refer to the general flow of gas through the engine.

The terms axial, radial and circumferential are made with reference to a rotational axis of the engine.

In operation of the gas turbine engine 10, air 24, which is taken in through the air inlet 12 is compressed by the compressor section 14 and delivered to the combustion section or burner section 16. The burner section 16 comprises a burner plenum 26, one or more combustion chambers 28 defined by a double wall can 27 and at least one burner 30 fixed to each combustion chamber 28. The combustion chambers 28 and the burners 30 are located inside the burner plenum 26. The compressed air passing through the compressor section 14 enters a diffuser 32 and is discharged from the diffuser 32 into the burner plenum 26 from where a portion of the air enters the burner 30 and is mixed with a gaseous or liquid fuel. The air/fuel mixture is then burned and the combustion gas 34 or working gas from the combustion is channeled via a transition duct 35 to the turbine section 18.

The turbine section 18 comprises a number of blade carrying discs 36 attached to the shaft 20. In the present example, two discs 36 each carry an annular array of turbine blades 38. The turbine blade devices 38 may be designed such as the above described airfoil devices 100. However, the number of blade carrying discs could be different, i.e. only one disc or more than two discs. In addition, guiding vanes 40, which are fixed to a stator 42 of the gas turbine engine 10, are disposed between the turbine blades 38. The guiding vanes 40 may be designed such as the above described airfoil devices 100. Between the exit of the combustion chamber 28 and the leading turbine blades 38 inlet guiding vanes 44 are provided.

The combustion gas from the combustion chamber 28 enters the turbine section 18 and drives the turbine blades 38 which in turn rotates the shaft 20. The guiding vanes 40, 44 serve to optimise the angle of the combustion or working gas on to the turbine blades 38. The compressor section 14 comprises an axial series of guide vane stages 46 and rotor blade stages 48.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

LIST OF REFERENCE SIGNS

10 gas turbine engine
12 inlet
14 compressor section
18 turbine section
20 shaft
24 air
26 burner plenum
27 can
28 combustion chamber
30 burner
32 diffuser
35 transition duct
36 disc
38 turbine blade
40 guiding vanes
42 stator
44 guiding vanes
46 guide vane stage
48 rotor blade stage
100 airfoil device
101 root section
102 airfoil element
103 platform
104 cavity
105 inner surface
106 first edge side
107 second edge side
108 seal strip
109 first end section
110 second end section
111 middle section
112 recess
113 supporting lever
114 contact region
115 further cavity
116 seal strip inlet
117 stopper section
121 axial direction
122 radial direction
123 circumferential direction
400 conventional airfoil device
401 conventional airfoil
402 conventional platform
403 conventional cavity
404 conventional root section
405 conventional seal strip

The invention claimed is:

1. An airfoil device for a gas turbine, the airfoil device comprising:

a root section which is mountable to an airfoil disc of the gas turbine, an airfoil element, wherein the root section comprises a platform at which the airfoil element is arranged, wherein the root section comprises a cavity which is surrounded by a radially inner surface of the platform, a first edge side of the root section and a second edge side of the root section, wherein the first edge side and the second edge side are spaced apart from each other along an axial direction of the gas turbine, and a seal strip which is arranged at the inner surface, wherein the seal strip comprises a first end section, a middle section and a second end section, wherein the first end section is spaced apart from the second end section along the axial direction and the middle section is arranged between the first end section and the second end section, wherein the first edge side comprises a recess into which the first end section of the seal strip is inserted such that the recess surrounds the first end section and fixes the first end section to the inner surface, wherein the root section comprises a supporting lever extending from the second edge side into the cavity such that a free end of the supporting lever forms a contact region with the middle section of the seal strip for fixing the middle section of the seal strip to the inner surface, wherein the supporting lever is further formed such that a further cavity is formed between the inner surface, the second edge side and the supporting lever, wherein the second end section of the seal strip is arranged inside the further cavity, and wherein the second edge side comprises a seal strip inlet fully through the second edge side configured to permit the seal strip to pass through the second edge side and move in the axial direction to enable installation and removal of the first end section into the recess in the first edge side.

2. The airfoil device according to claim 1, wherein a first part of the middle section of the seal strip between the contact region and the first end section is arranged inside the cavity, wherein the second end section and a second part of the middle section of the seal strip between the contact region and the second end section is arranged inside the further cavity.

3. The airfoil device according to claim 1, wherein the supporting lever is formed such that a first axial length of the seal strip between the contact region and the first end section is larger than a second axial length of the seal strip between the contact region and the second end section.

4. The airfoil device according to claim 1, wherein the seal strip inlet is formed such that air is streamable out of the further cavity.

5. The airfoil device according to claim 1, wherein the second edge side comprises a stopper section which is formed such that the second end section of the seal strip abuts against the stopper section.

6. The airfoil device according to claim 1, wherein the first edge side is a trailing edge side of the root section, and wherein the second edge side is a leading edge side of the root section.

7. An airfoil arrangement for a gas turbine, the airfoil arrangement comprising an airfoil device according to claim 1, and a further airfoil device according to claim 1, wherein the airfoil device and the further airfoil device are arranged one after another along a circumferential direction of the gas turbine, wherein the seal strip is formed such that the seal strip extends between the airfoil device and the further airfoil device for sealing a gap between the airfoil device and the further airfoil device.

8. The airfoil device according to claim 5, wherein the stopper section is disposed immediately radially outward of the seal strip inlet.

9. An airfoil device for a gas turbine, the airfoil device comprising:

an airfoil element, a root section which is mountable to an airfoil disc of the gas turbine, comprising: a platform at which the airfoil element is arranged; a cavity which is surrounded by a radially inner surface of the platform; a first edge side of the root section; and a second edge side of the root section, wherein the first edge side and the second edge side are spaced apart from each other along an axial direction of the gas turbine, and a seal strip which is arranged at the radially inner surface, comprising: a first end section; a middle section; and a second end section, wherein the first end section is spaced apart from the second end section along the axial direction, and wherein the middle section is arranged between the first end section and the second end section, wherein the first edge side comprises a recess into which the first end section of the seal strip is inserted such that the recess surrounds the first end section and fixes the first end section to the radially inner surface, wherein the root section comprises a supporting lever that extends into the cavity such that a free end of the supporting lever forms a contact region with the middle section of the seal strip for fixing the middle section of the seal strip to the radially inner surface, wherein the supporting lever extends along the axial direction from a leading edge of the platform toward a trailing edge of the platform, and is inclined such that a trailing end of the supporting lever is closer to the platform than a leading end of the supporting lever, wherein the supporting lever is further formed such that a further cavity is formed between the radially inner surface, the second edge side and the supporting lever, and wherein the second end section of the seal strip is arranged inside the further cavity.

* * * * *